US008764375B2

(12) United States Patent
Kato et al.

(10) Patent No.: US 8,764,375 B2
(45) Date of Patent: Jul. 1, 2014

(54) COUNTER-ROTATING AXIAL FLOW FAN

(75) Inventors: Chisachi Kato, Tokyo (JP); Atsushi Yamaguchi, Kanagawa (JP); Akira Ueda, Kanagawa (JP); Kazuhiro Nitta, Kanagawa (JP); Akihiro Otsuka, Kanagawa (JP); Tadashi Katsui, Kanagawa (JP); Masahiro Suzuki, Kanagawa (JP); Yoshihiko Aizawa, Nagano (JP); Honami Oosawa, Nagano (JP)

(73) Assignees: The University of Tokyo, Tokyo (JP); Fujitsu Limited, Kawasaki-shi (JP); Sanyo Denki Co., Ltd., Tokyo (JP)

( * ) Notice: Subject to any disclaimer, the term of this patent is extended or adjusted under 35 U.S.C. 154(b) by 767 days.

(21) Appl. No.: 12/967,192

(22) Filed: Dec. 14, 2010

(65) Prior Publication Data

US 2011/0142611 A1 Jun. 16, 2011

(30) Foreign Application Priority Data

Dec. 14, 2009 (JP) ..... 2009-283286

(51) Int. Cl.
*F04D 19/02* (2006.01)

(52) U.S. Cl.
USPC ..... 415/68; 416/128

(58) Field of Classification Search
USPC ..... 361/687, 690, 694, 695; 415/60, 66, 68, 415/213.1, 214.1; 416/120, 124, 125, 128
See application file for complete search history.

(56) References Cited

U.S. PATENT DOCUMENTS

| | | | | |
|---|---|---|---|---|
| 631,552 | A | 8/1899 | Atherton | |
| 3,083,893 | A * | 4/1963 | Dean | 417/247 |
| 6,537,019 | B1 * | 3/2003 | Dent | 415/61 |
| 7,156,611 | B2 * | 1/2007 | Oosawa et al. | 415/68 |
| 7,445,423 | B2 * | 11/2008 | Ishihara et al. | 415/61 |
| 7,909,568 | B2 * | 3/2011 | Ishihara et al. | 415/61 |
| 8,007,234 | B2 * | 8/2011 | Yoshida | 415/222 |
| 8,172,501 | B2 * | 5/2012 | Nishizawa et al. | 415/68 |
| 8,348,593 | B2 * | 1/2013 | Yoshida | 415/66 |

(Continued)

FOREIGN PATENT DOCUMENTS

| | | |
|---|---|---|
| CN | 1971065 | 5/2007 |
| CN | 200982304 Y | 11/2007 |

(Continued)

OTHER PUBLICATIONS

Chinese Office Action with English Translation dated Feb. 8, 2014, 8 pages.

*Primary Examiner* — Edward Look
*Assistant Examiner* — Christopher R Legendre
(74) *Attorney, Agent, or Firm* — Rankin, Hill & Clark LLP

(57) ABSTRACT

A counter-rotating axial flow fan with improved characteristics and reduced noise compared to the related art can be provided. Defining the number of front blades as N, the number of stationary blades as M, and the number of rear blades as P, and defining the maximum axial chord length of the front blades as Lf, the maximum axial chord length of the rear blades as Lr, the outside diameter of the front blades as Rf, and the outside diameter of the rear blades as Rr, the counter-rotating axial flow fan satisfies the following two relationships: $N \geq P > M$; and $Lf/(Rf \times \pi/N) \geq 1.25$ and/or $Lr/(Rr \times \pi/P) \geq 0.83$.

15 Claims, 13 Drawing Sheets

(56) References Cited

U.S. PATENT DOCUMENTS

| | | | | |
|---|---|---|---|---|
| 2006/0193724 | A1* | 8/2006 | Liu | 415/220 |
| 2007/0059155 | A1 | 3/2007 | Ishihara et al. | |
| 2009/0047118 | A1 | 2/2009 | Ishihara et al. | |
| 2011/0142611 | A1* | 6/2011 | Kato et al. | 415/206 |
| 2011/0142614 | A1* | 6/2011 | Kato et al. | 415/220 |
| 2012/0257957 | A1* | 10/2012 | Yanagisawa et al. | 415/61 |

FOREIGN PATENT DOCUMENTS

| | | | | |
|---|---|---|---|---|
| JP | 10288199 | A * | 10/1998 | F04D 31/00 |
| JP | 4128194 | | 7/2008 | |
| WO | WO 2010081294 | A1 * | 7/2010 | F04D 29/32 |

* cited by examiner

Fig.5

| | | C0 ; C0′ | E1 | E2 | E3 | C1 | C2 | C3 | C4 | C5 |
|---|---|---|---|---|---|---|---|---|---|---|
| NUMBER OF BLADES | FRONT BLADES | 5 | 7 | 7 | 7 | 5 | 5 | 5 | 5 | 7 |
| | STATIONARY BLADES | 3 | 4 | 4 | 4 | 7 | 3 | 4 | 4 | 9 |
| | REAR BLADES | 4 | 6 | 6 | 6 | 3 | 4 | 5 | 3 | 5 |
| MAXIMUM AXIAL CHORD LENGTH | FRONT BLADES | 22.8 | 22.8 | 22.8 | 22.8 | 24.2 | 22.0 | 19.0 | 25.6 | 19.9 |
| | REAR BLADES | 16.7 | 16.7 | 24.8 | 16.7 | 12.4 | 16.2 | 9.7 | 14.71 | 9.6 |
| AXIAL CHORD LENGTH/ BLADE DIAMETER | REAR BLADES | 0.455 | 0.455 | 0.676 | 0.455 | 0.338 | 0.438 | 0.263 | 0.401 | 0.530 |
| CHORD LENGTH | FRONT BLADES | 29.4 | 27.9 | 27.9 | 27.9 | 27.0 | 27.6 | 26.1 | 28.8 | 26.5 |
| | REAR BLADES | 23.7 | 23.4 | 33.9 | 23.4 | 18.0 | 24.3 | 16.6 | 20.4 | 30.3 |
| SOLIDITY (AXIAL CHORD LENGTH/ (BLADE OUTSIDE DIAMETER*π/ NUMBER OF BLADES)) | FRONT BLADES (A) | 0.955 | 1.336 | 1.336 | 1.336 | 1.011 | 0.921 | 0.787 | 1.072 | 1.158 |
| | REAR BLADES (B) | 0.560 | 0.839 | 1.246 | 0.839 | 0.311 | 0.541 | 0.402 | 0.369 | 0.814 |
| | REAR BLADES/ FRONT BLADES (B/A) | 0.586 | 0.628 | 0.933 | 0.628 | 0.307 | 0.588 | 0.511 | 0.345 | 0.704 |
| SOLIDITY (CHORD LENGTH/ (BLADE OUTSIDE DIAMETER*π/ NUMBER OF BLADES)) | FRONT BLADES (A′) | 1.231 | 1.638 | 1.638 | 1.638 | 1.128 | 1.156 | 1.082 | 1.206 | 1.542 |
| | REAR BLADES (B′) | 0.794 | 1.176 | 1.702 | 1.176 | 0.451 | 0.812 | 0.688 | 0.513 | 1.259 |
| | REAR BLADES/ FRONT BLADES (B/A) | 0.645 | 0.718 | 1.039 | 0.718 | 0.400 | 0.702 | 0.636 | 0.425 | 0.817 |

COUNTER-ROTATING AXIAL FLOW FAN

TECHNICAL FIELD

The present invention relates to a counter-rotating axial flow fan with a front impeller and a rear impeller configured to rotate in opposite directions to each other.

BACKGROUND ART

FIGS. 1 and 2 show the structure of a counter-rotating axial flow fan disclosed in Japanese Patent No. 4128194. FIGS. 1A, 1B, 1C, and 1D are respectively a perspective view as viewed from a suction side, a perspective view as viewed from a discharge side, a front view as viewed from the suction side, and a rear view as viewed from the discharge side, of the counter-rotating axial flow fan according to the related art. FIG. 2 is a vertical cross-sectional view of the counter-rotating axial flow fan of FIG. 1. The counter-rotating axial flow fan is constructed by assembling a first axial flow fan unit 1 and a second axial flow fan unit 3 via a coupling structure. The first axial flow fan unit 1 includes a first casing 5, and a first impeller (front impeller) 7, a first motor 25, and three webs 21 disposed in the first casing 5. The webs 21 are arranged at intervals of 120° in the circumferential direction. The first casing 5 has an annular flange 9 on the suction side in the direction in which the axial line A extends (in the axial direction), and an annular flange 11 on the discharge side, which is opposite to the suction side, in the axial direction. The first casing 5 also has a cylindrical portion 13 between the flanges 9 and 11. The internal spaces in the flange 9, the flange 11, and the cylindrical portion 13 form an air channel. The flange 11 on the discharge side has a circular opening portion 17 formed therein. The three webs 21 of the first axial flow fan unit 1 are assembled with three webs 45 of the second axial flow fan unit 3 to form three stationary blades 61 as explained later. The first motor 25 rotates the first impeller 7 in the first casing 5 in the counterclockwise direction in FIG. 1C (in the direction of the arrow R1 on the paper, which will be referred to as "one direction R1"). The first motor 25 rotates the first impeller 7 at a rotational speed higher than the rotational speed of a second impeller (rear impeller) 35 as explained later. The first impeller 7 has an annular member (hub) 27 fitted with a cup-shaped member of a rotor (not shown) fixed to a rotary shaft (not shown) of the first motor 25, and N (five) front blades 28 integrally provided on an outer peripheral surface of an annular peripheral wall 27*a* of the annular member 27.

The second axial flow fan unit 3 includes a second casing 33, and a second impeller (rear impeller) 35, a second motor 49, and three webs 45 disposed in the second casing 33 and shown in FIG. 2. As shown in FIG. 1, the second casing 33 has a flange 37 on the suction side in the direction in which the axial line A extends (in the axial direction), and a flange 39 on the discharge side, which is opposite to the suction side, in the axial direction. The second casing 33 also has a cylindrical portion 41 between the flanges 37 and 39. The internal spaces in the flange 37, the flange 39, and the cylindrical portion 41 form an air channel. The first casing 5 and the second casing 33 form a case. The flange 37 on the suction side has a circular opening portion 42 formed therein. The second motor 49 rotates the second impeller 35 in the second casing 33 in the counterclockwise direction in FIGS. 1B and 1D or in the direction of the arrow R2 on the paper, which will be referred to as "other direction R2", that is, in the direction opposite to the direction of rotation of the first impeller 7 (the direction of the arrow R1). As explained earlier, the second impeller 35 is rotated at a rotational speed lower than the rotational speed of the first impeller 7. The second impeller 35 has an annular member (hub) 50 fitted with a cup-shaped member of a rotor (not shown, fixed to a rotary shaft (not shown) of the second motor 49, and P (four) rear blades 51 integrally provided on an outer peripheral surface of an annular peripheral wall 50*a* of the annular member 50.

The front blades 28 each have a curved shape in which a concave portion opens toward the one direction R1 as viewed in lateral cross section. The rear blades 51 each have a curved shape in which a concave portion opens toward the other direction R2 as viewed in lateral cross section. The stationary blades (support members) 61 each have a curved shape in which a concave portion opens toward the other direction R2 and toward the direction in which the rear blades 51 are located as viewed in lateral cross section.

In the counter-rotating axial flow fan, the number N of the front blades 28, the number M of the stationary blades 61, and the number P of the rear blades 51 are each a positive integer, and satisfy a relationship of N>P>M. In the counter-rotating axial flow fan, as shown in FIG. 2, the length (maximum axial chord length) L1 of the N front blades 28 of the first axial flow fan unit 1 as measured along the direction of the axial line A is set to be larger than the length (maximum axial chord length) L2 of the P rear blades 51 of the second axial flow fan unit 3 as measured along the direction of the axial line A. Specifically, the two lengths L1 and L2 are determined such that the ratio L1/L2 of the length L1 to the length L2 is a value of 1.3 to 2.5 to improve the air flow—static pressure characteristics.

While the conventional counter-rotating axial flow fan can improve the air flow—static pressure characteristics, it is desired to further improve the characteristics and reduce noise.

SUMMARY OP THE INVENTION

An object of the present invention is to provide a counter-rotating axial flow fan with improved characteristics and reduced noise.

The present invention provides a counter-rotating axial flow fan including: a casing including an air channel having a suction port on one side in an axial direction and a discharge port on the other side in the axial direction; a front impeller including a plurality of front blades and configured to rotate in the air channel; a rear impeller including a plurality of rear blades and configured to rotate in the air channel in a direction opposite to a direction of rotation of the front impeller; and a plurality of support members formed by a plurality of stationary blades or a plurality of struts (support members not having a function as stationary blades) disposed to be stationary between the front impeller and the rear impeller in the air channel.

In the counter-rotating axial flow fan according to the present invention, defining the number of the front blades as N, the number of the support members as M, and the number of the rear blades as P, N, M, and P each being a positive integer, and defining the maximum axial chord length of the front blades (the maximum length of the front blades as measured in parallel with the axial direction) as Lf, the maximum axial chord length of the rear blades (the maximum length of the rear blades as measured in parallel with the axial direct ion) as Lr, the outside diameter of the front blades (the maximum diameter of the front impeller including the front blades as measured in the radial direction orthogonal to the axial direction) as Rf, and the outside diameter of the rear blades (the maximum diameter of the rear impeller including the rear blades as measured in the radial direction orthogonal to the axial direction) as Rr, Lf, Lr, Rf, and Rr each being a positive integer, the following relationships are satisfied: $N \geq P > M$; and at least one of $Lf/(Rf \times \pi/N) \geq 1.25$ and $Lr/(Rr \times \pi/P) \geq 0.83$.

The above relationships have been found by the inventors as a result of study to achieve a counter-rotating axial flow fan with improved characteristics and reduced noise. The conventional or existing counter-rotating axial flow fans do not satisfy the above relationships. It has been verified that the counter-rotating axial flow fan that satisfies at least the above relationships may reduce loss, improve characteristics, and reduce noise compared to the existing counter-rotating axial flow fans. The present invention has been made on the basis of such verifications.

In the present invention, the above relationships are determined to obtain the effect of reducing a loss caused by the rear blades and to enable the rear blades to work to rectify a swirling flow (or to cause the rear blades to work to discharge exhausted air or blow air as well as to do what the ordinary stationary blades do). The above relationships are the minimum conditions for causing the rear blades, in particular, to produce the above effect. The above relationship to be satisfied by the front blades is a condition for causing the rear blades to produce the above effect as much as possible by modifying the structure of the front blades without modifying the rear blades. The above relationship to be satisfied by the rear blades is a condition for causing the rear blades to produce the above effect as much as possible by modifying the structure of the rear blades without modifying the front blades.

While the above effect can be obtained with the above relationships alone, it is preferable that defining the rotational speed of the front impeller as Sf and the rotational speed of the rear impeller as Sr, a relationship of $Sf > Sr$ is satisfied, in addition to the above relationships. This relationship is a condition for the front impeller to achieve an effect of increasing flow rate and for the rear impeller to supplement a rectifying effect provided by the stationary blades.

The above effect is further enhanced if the following relationships are further satisfied in addition to the above relationships: $5 \leq N \leq 7$, $4 \leq P \leq 7$, and $3 \leq M \leq 5$; $1 > Lr/Lf > 0.45$; and $Lf/(Rf \times \pi/N) > Lr/(Rr \times \pi/P)$. The above effect is still further enhanced if a relationship of $Lf/(Rf \times \pi/N) \geq 1.59$ or a relationship of $Lr/(Rr \times \pi/P) \geq 1.00$ is satisfied in addition to the above relationships.

The front impeller and the rear impeller may each be formed by fixing the plurality of blades to an outer peripheral portion of a hub thereof. Preferably, the radial dimension of the hub of the rear impeller, in particular, becomes smaller toward the discharge port. With such a configuration, the static pressure level can be increased to improve the static pressure characteristics. In this case, preferably, the inclination angle of an outer surface of the hub of the rear impeller is less than 60 degrees. If the inclination angle is not less than 60 degrees, the static pressure level may not be increased.

End portions of the rear blades may be in contact with an end portion of the hub of the rear impeller on the discharge side. That is, the rear blades extend to the end portion of the hub on the discharge side. With such a structure, the rectifying effect provided by the rear blades can be enhanced.

Still further, it is desired that end surfaces of the rear blades of the rear impeller on the discharge side may be disposed more inwardly than an end surface of the casing on the discharge side not to project from the end surface of the casing on the discharge side. Also with such a structure, the static pressure can be enhanced.

BRIEF DESCRIPTION OF THE DRAWINGS

FIG. 5 shows the constituent elements of fans used to verify the effect of the embodiment.

DESCRIPTION OF THE PREFERRED EMBODIMENTS

Figure 1A:
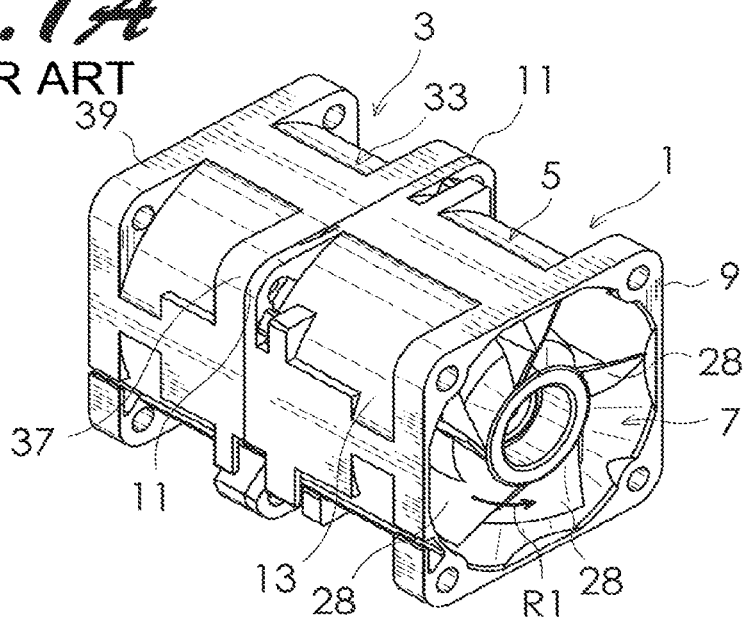
Fig. 1A PRIOR ART
FIGS. 1A, 1B, 1C, and 1D are respectively a perspective view as viewed from a suction side, a perspective view as viewed from a discharge side, a front view as viewed from the suction side, and a rear view as viewed from the discharge side, of a conventional counter-rotating axial flow fan.
Figure 1B:
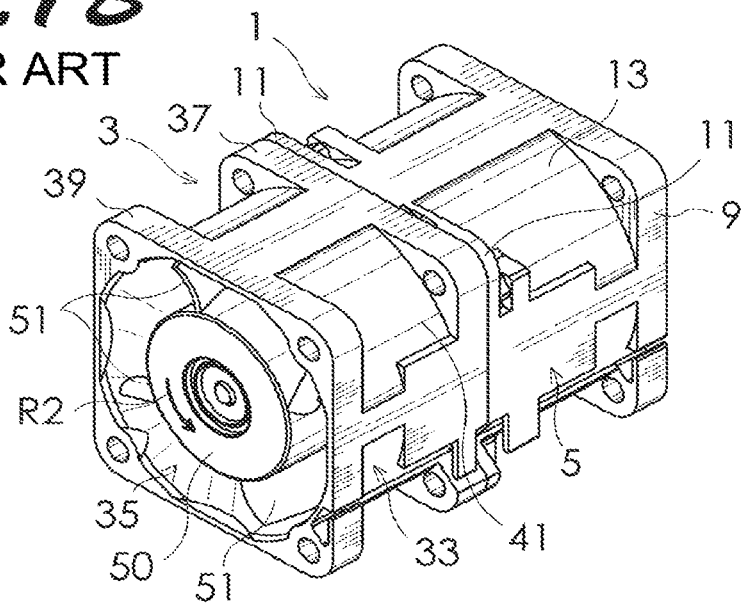
Fig. 1B PRIOR ART
Figure 1C:
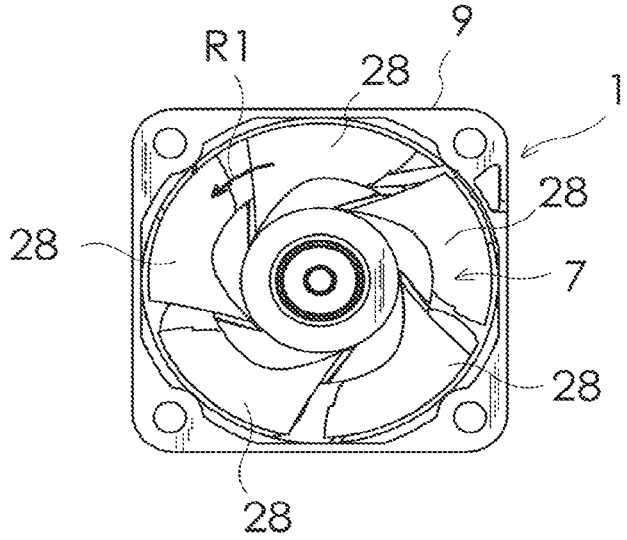
Fig. 1C PRIOR ART
Figure 1D:
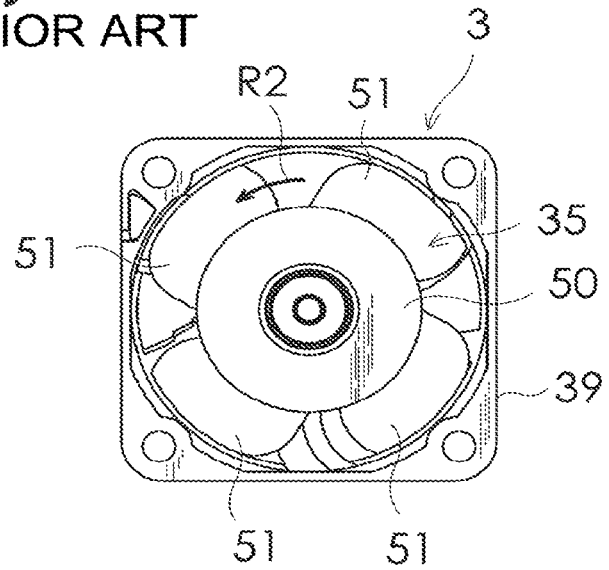
Fig. 1D PRIOR ART
Figure 2:
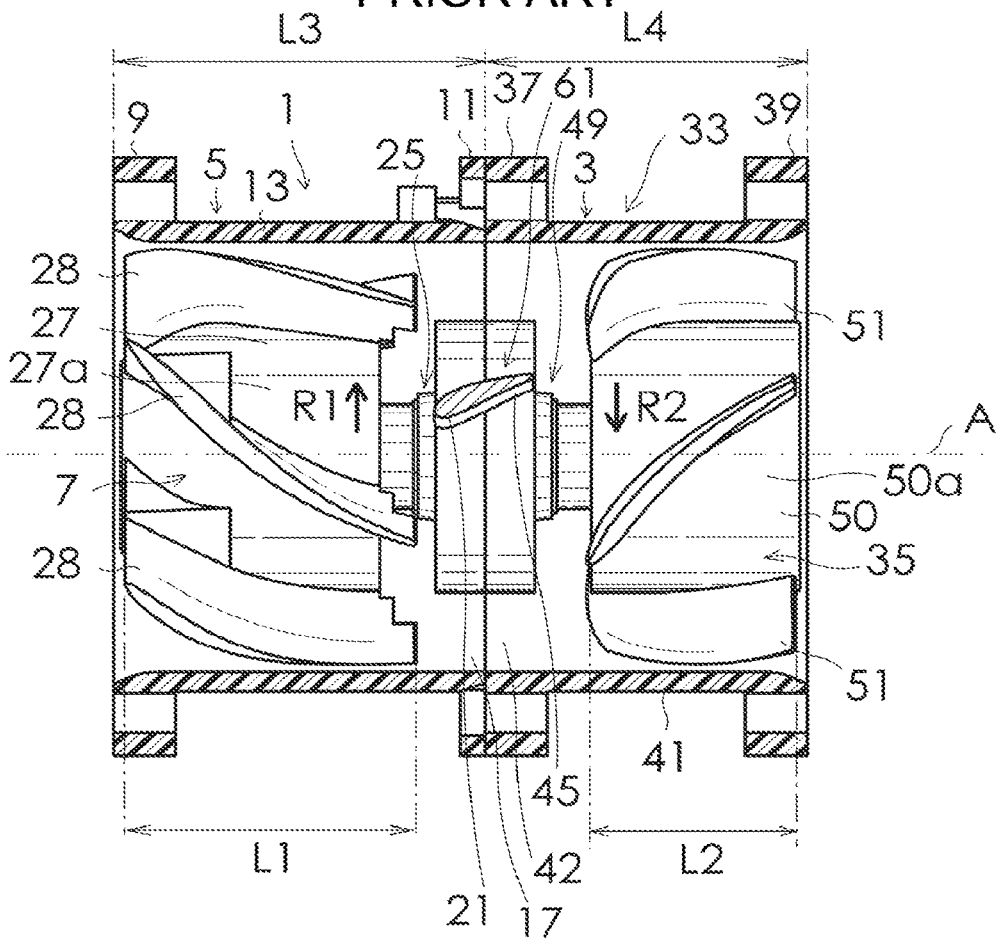
Fig. 2 PRIOR ART
FIG. 2 is a vertical cross-sectional view of the counter-rotating axial flow fan of FIG. 1.
Figure 3:
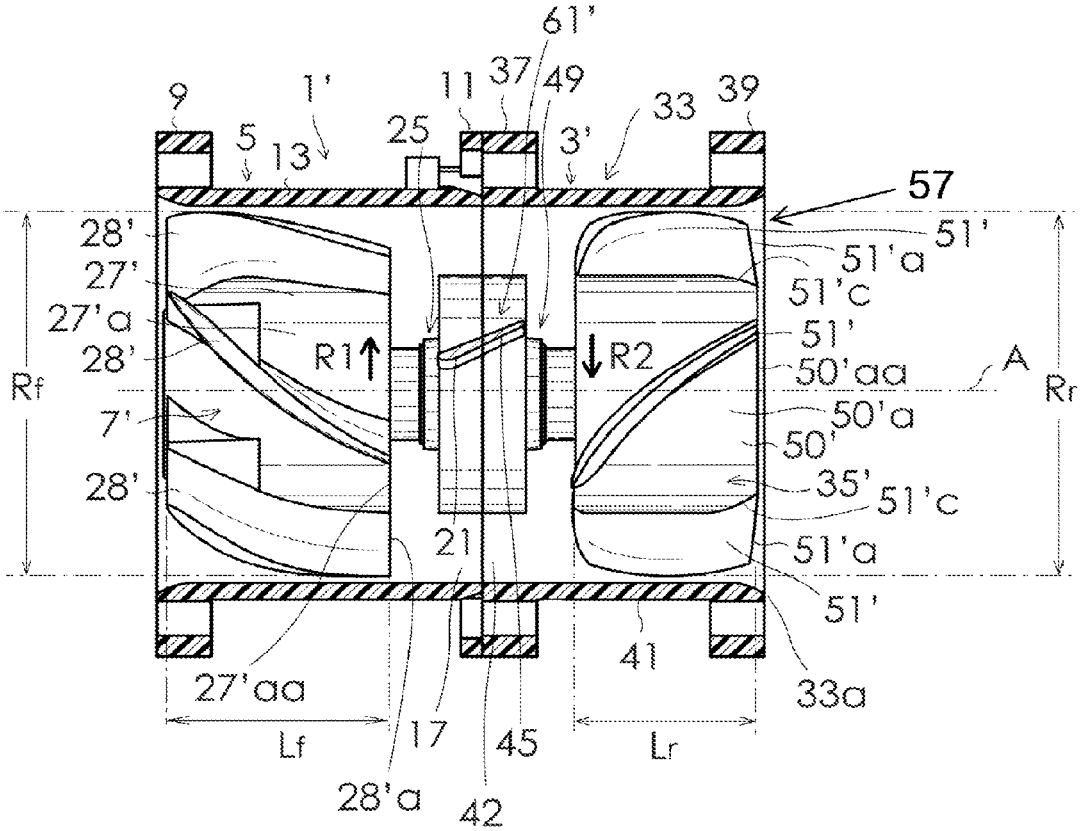
FIG. 3 illustrates the schematic configuration of a counter-rotating axial flow fan according to the present

A counter-rotating axial flow fan according to an embodiment of the present invention will be described below with reference to the drawings. FIG. 3 illustrates the schematic configuration of a counter-rotating axial flow fan according to the embodiment of the present invention. The configuration of the counter-rotating axial flow fan according to the embodiment is basically the same as that of the conventional counter-rotating axial flow fan shown in FIGS. 1 and 2 except for the shape of a front impeller 7', the shape of a rear impeller 35', and the shape of stationary blades 61'. Thus, in the embodiment, components in FIG. 3 that are the same as those forming the counter-rotating axial flow fan shown in FIGS. 1 and 2 are denoted by the same reference numerals as those given in FIGS. 1 and 2, and different components in FIG. 3 are denoted by reference numerals obtained by suffixing an apostrophe (') to the reference numerals given in FIGS. 1 and 2, and detailed descriptions are omitted.

In the embodiment, the first impeller, that is, the front impeller 7' has an annular member, that is, a hub 27' fitted with a cup-shaped member of a rotor (not shown) fixed to a rotary shaft (not shown) of the first motor 25, and N (five) front blades 28' integrally provided on an outer peripheral surface of an annular peripheral wall 27'*a* of the hub 27'. End surfaces 28'*a* of the front blades 28' on the discharge port side coincide with an end surface 27'*aa* of the peripheral wall 27'*a* of the hub 27' on the discharge port side. The maximum axial chord length Lf of the front blades 28' (the maximum length of the front blades 28' as measured along the axial direction) is smaller than that in the fan shown in FIGS. 1 and 2. The second impeller, that is, the rear impeller 35' has an annular member, that is, a hub 50' fitted with a cup-shaped member of a rotor (not shown) fixed to a rotary shaft (not shown) of the second motor 49, and P (four) rear blades 51' integrally provided on an outer peripheral surface of an annular peripheral wall 50'*a* of the hub 50'. The rear impeller 35' is rotated at a rotational speed Sr lower than the rotational speed Sf of the front impeller 7'.

Figure 4A:
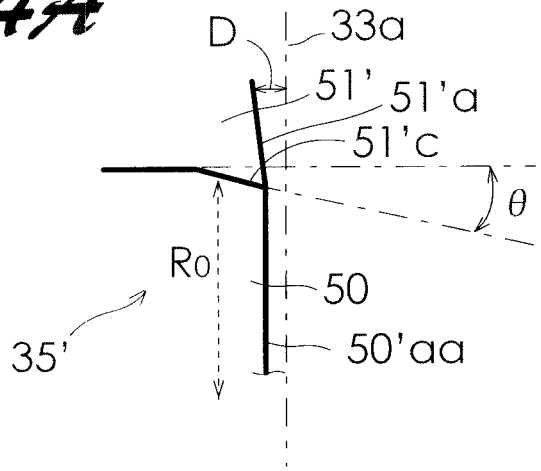
FIG. 4 shows a part of a rear impeller as enlarged.
Figure 4B:
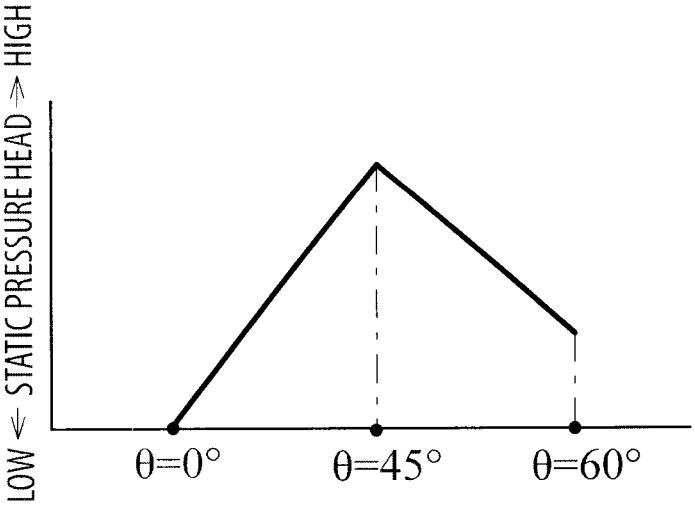

In the embodiment, as shown in FIGS. 3 and 4A, the hub 50' of the rear impeller 35' includes a tapered surface 51'*c* in a truncated conical shape in which the radial dimension Ro of the hub 50' becomes smaller toward a discharge port 57. As shown in FIG. 4A, preferably, the inclination angle θ of the tapered surface 51'*c* of the hub 50' is less than 60 degrees. As seen in the tendency of the rate of improvement in sensitivity of the static pressure with θ shown in FIG. 4B, the effect of the static pressure becomes smaller if the inclination angle is not less than 60°. End portions 51'*a* of the rear blades 51' are in contact (continuous) with an end portion 50'*aa* of the hub 50' of the rear impeller 35' on the discharge side. That is, the rear blades 51' extend to the end portion 50'*aa* of the hub 50' on the discharge side. With such a structure, the rectifying effect provided by the rear blades 51' can be enhanced. End surfaces of the end portions 51' a of the rear blades 51' of the rear impeller 35' on the discharge side are disposed more inwardly than an end surface 33*a* of the second casing 33 (a part of the case) on the discharge port 57 side by a distance D not to project from the end surface 33*a* of the casing on the discharge side. The distance D may be in the range of 0.1 to 0.5 times the diameter Rr of the rear blades 51'. With such a configuration, the effect of reducing noise can be enhanced.

The three stationary blades 61', which are respectively formed by assembling or combining the three webs 21' of the first axial flow fan unit 1' and the three webs 45' of the second axial flow f an unit 3' to each other, have the same shape as each other, and are disposed at equal intervals (at intervals of 120°) in the circumferential direction. The stationary blades 61' used in the embodiment are ideally shaped such that the center line of each blade is substantially straight, or preferably shaped to have substantially no blade load. That is, the stationary blades 61' are preferably shaped to provide substantially no resistance to an air flow. The stationary blades 61' in such a shape achieves no rectifying effect unlike ordinary stationary blades.

In the counter-rotating axial flow fan according to the present invention, defining the number of the front blades as N, the number of the stationary blades (support members) as M, and the number of the rear blades as P, N, M, and P each being a positive integer, and defining the maximum axial chord length of the front blades (the maximum length of the front blades as measured along the axial direction) as Lf, the maximum axial chord length of the rear blades (the maximum length of the rear blades as measured along the axial direction) as Lr, the outside diameter of the front blades (the maximum diameter of the front impeller including the front blades as measured in the radial direction orthogonal to the axial direction) as Rf, and the outside diameter of the rear blades (the maximum diameter of the rear impeller including the rear blades as measured in the radial direction orthogonal to the axial direction) as Rr, Lf, Lr, Rf, and Rr each being a positive integer, the following relationships are satisfied. In the description below, the values of the relationship 2 below are each referred to as "solidity".

$$N \geq P > M \qquad \text{Relationship 1}$$

$$Lf/(Rf \times \pi/N) \geq 1.25$$

and/or $$Lr/(Rr \times \pi/P) \geq 0.83 \qquad \text{Relationship 2}$$

The counter-rotating axial flow fan shown in FIG. 1 and FIG. 2 is provided with stationary blades that positively achieve a flow rate reducing function (rectifying function). That is, the counter-rotating axial flow fan shown in FIG. 1 and FIG. 2 includes stationary blades configured to smoothly guide an air flow from the front blades to the rear blades. The rear blades shown in FIG. 1 and FIG. 2 are designed to reduce the influence of the front blades on the air flow. In contrast to such a design concept according to the prior art, the embodiment of the present invention adopts a design concept for reducing a loss caused by the stationary blades as much as possible. Moreover, the above relationships 1 and 2 are determined to obtain the effect of reducing a loss caused by the rear blades 51' and to enable the rear blades 51' to work to rectify a swirling flow (or to cause the rear blades 51' to discharge exhausted air or to blow air as well as do what the ordinary stationary blades do). The above relationships 1 and 2 are the minimum conditions for causing the rear blades 51', in particular, to produce the above effect. The relationship 2, in particular, determines the structure of the front blades 28' and/or the structure of the rear blades 51'. The above relationship to be satisfied by the front blades 28' is a condition for causing the rear blades 51' to produce the above effect as much as possible by modifying the structure of the front blades 28' without modifying the rear blades 51'. The above relationship to be satisfied by the rear blades 51' is a condition for causing the rear blades 51' to produce the above effect as much as possible by modifying the structure of the rear blades 51' without modifying the front blades 28'.

While the above effect can be obtained with the above relationships 1 and 2 alone, it is preferable that defining the rotational speed of the front impeller 7' as Sf and the rotational speed of the rear impeller 35' as Sr, a relationship of Sf>Sr should be satisfied, in addition to the above relationships 1 and 2. This relationship is a condition for the front impeller 7' to achieve an effect of increasing flow rate and for the rear impeller 35' to supplement a rectifying effect (effect of rectifying a swirling flow) provided by the ordinary stationary blades.

The above effect can be further enhanced if the following relationships are further satisfied in addition to the above relationships: $5 \leq N \leq 7$, $4 \leq P \leq 7$, and $3 \leq M \leq 5$; $1 > Lr/Lf > 0.45$; and $Lf/(Rf \times \pi/N) > Lr/(Rr \times \pi/P)$. The above effect can be still further enhanced if a relationship of $Lf/(Rf \times \pi/N) \geq 1.59$ or a relationship of $Lr/(Rr \times \pi/P) \geq 1.00$ is satisfied. These relationships have been verified through testing.

FIG. 5 shows the constituent elements of fans used to verify the effect of the embodiment. In FIG. 5, Examples E1 to E3 are the same in basic structure as the embodiment shown in FIG. 3, but different in the number of the rotary blades (the front blades and the rear blades), the number of the stationary blades, the maximum axial chord length of the rotary blades, and the outside diameter of the rotary blades. Comparative Example C0 is the same in basic structure as the embodiment shown in FIG. 3, but different in the number of the rotary blades, the number of the stationary blades, the maximum axial chord length of the rotary blades, and the outside diameter of the rotary blades for comparison. Comparative Example C0' is the same as Comparative Example C0 in the number of the rotary blades, the number of the stationary blades, and the maximum axial chord length of the rotary blades, but larger in warping of the rotary blades than Comparative Example C0. In Comparative Example C0', the degree of warping is increased compared to Comparative Example C0 as far as the solidity is not affected.

Comparative Examples C1 to C5 are five types of conventional counter-rotating axial flow fans currently available in the market. The "chord length" in FIG. 5 refers to the length of the blades as measured along the edge portion of the blades. These fans were selectively tested as described below. The "solidity" in the lowermost row of FIG. 5 indicates a typical solidity value represented with the chord length as the numerator.

Figure 6A:
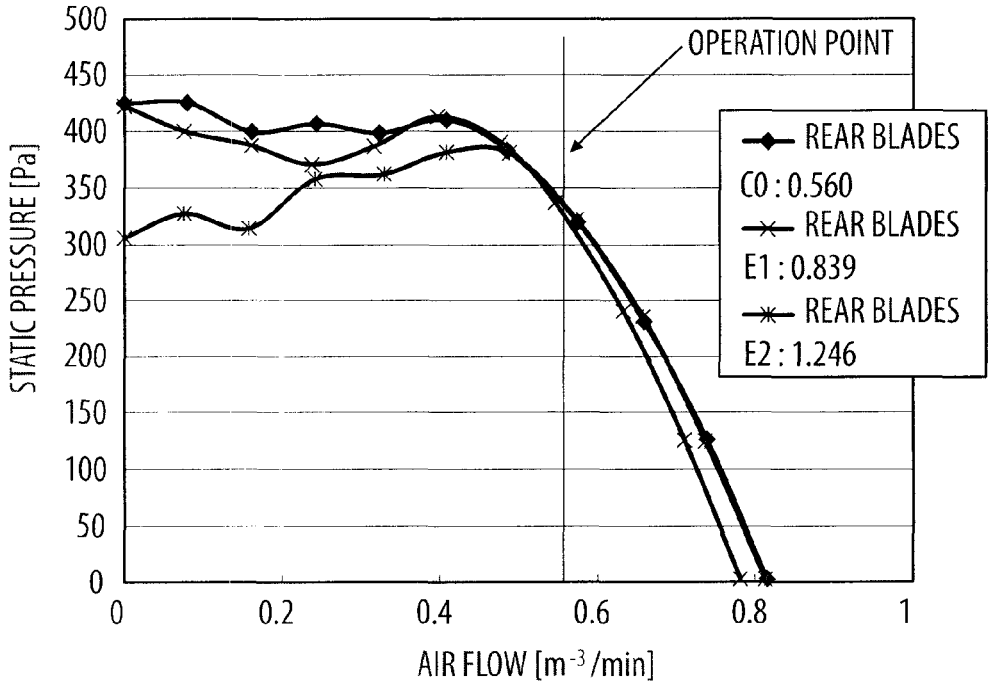
FIGS. 6A and 6B are respectively graphs showing the static pressure—air flow characteristics and the noise—air flow characteristics measured for Example E1, Example E2, and Comparative Example C0 of FIG. 5.
Figure 6B:
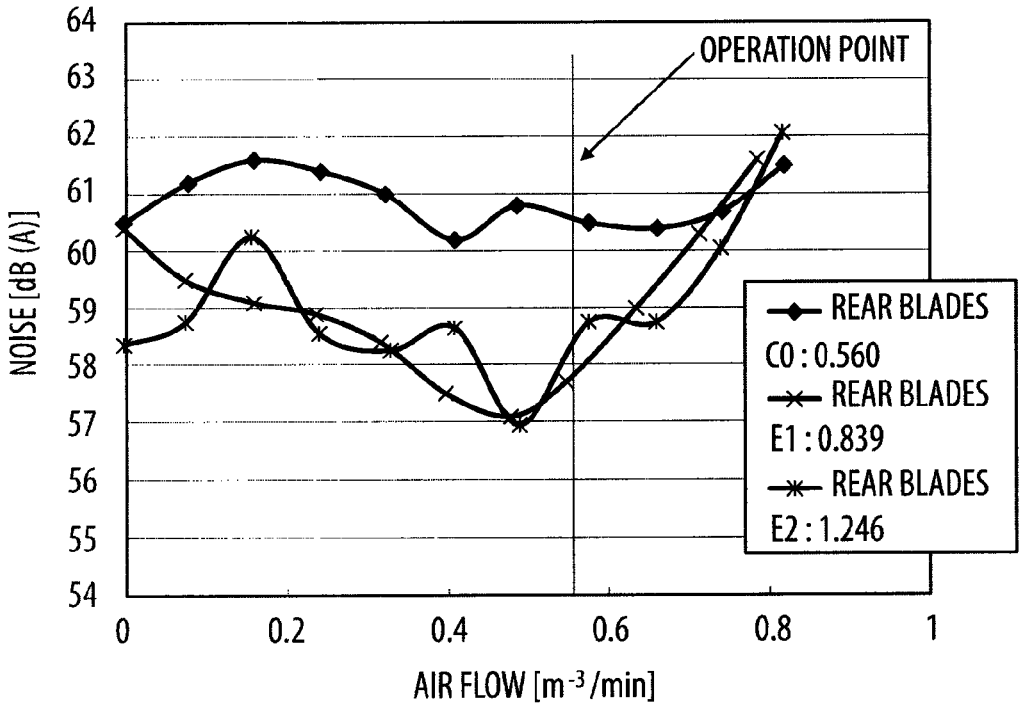

FIGS. 6A and 6B are respectively graphs showing the static pressure—air flow characteristics and the noise—air flow characteristics measured for Example E1, Example E2, and Comparative Example C0 of FIG. 5. As seen from these graphs, if a comparison is made among counter-rotating axial flow fans with the solidity of the front blades defined by the above relationship 2 set to be fixed and with the solidity of the rear blades defined by the above relationship 2 respectively set to 0.560, 0.839, and 1.296, noise can be reduced with the counter-rotating axial flow fan with the solidity of the rear blades set to 0.839 at an operation point with no significant variations in static pressure—air flow characteristics. Although not shown in FIG. 6, it has been verified through simulation that the effect is obtained with the solidity of the rear blades set to 0.83 or more. The upper Limit of the solidity of the rear blades is inevitably determined under conditions of manufacturing actual products, and thus the solidity of the rear blades will not be an infinite value.

Figure 7A:
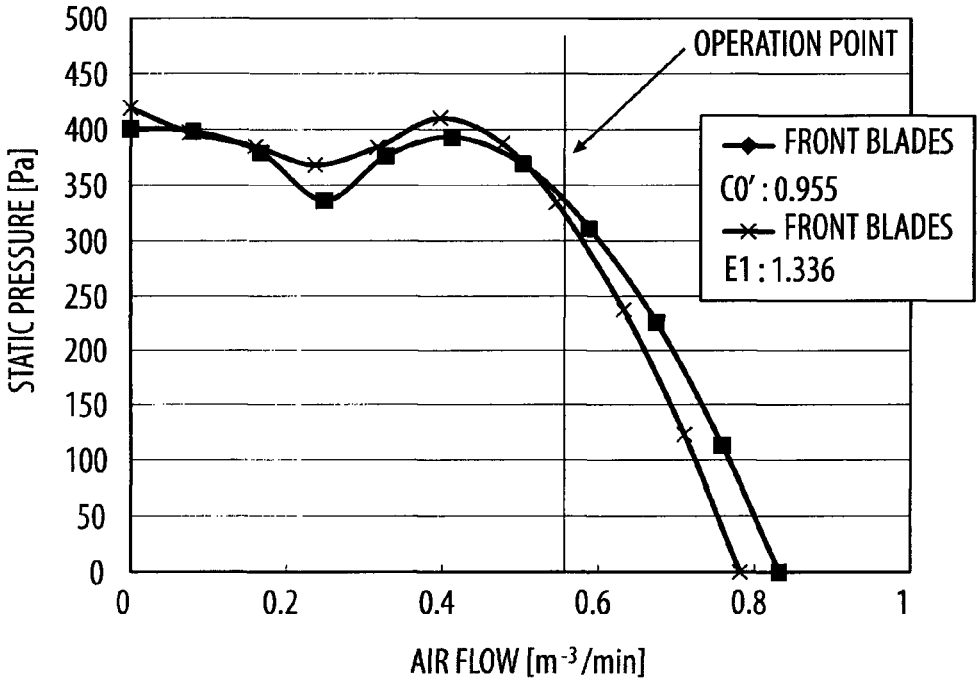
FIGS. 7A and 7B are respectively graphs showing the static pressure—air flow characteristics and the noise—air flow characteristics measured for Example E1 and Comparative Example C0' of FIG. 5.
Figure 7B:
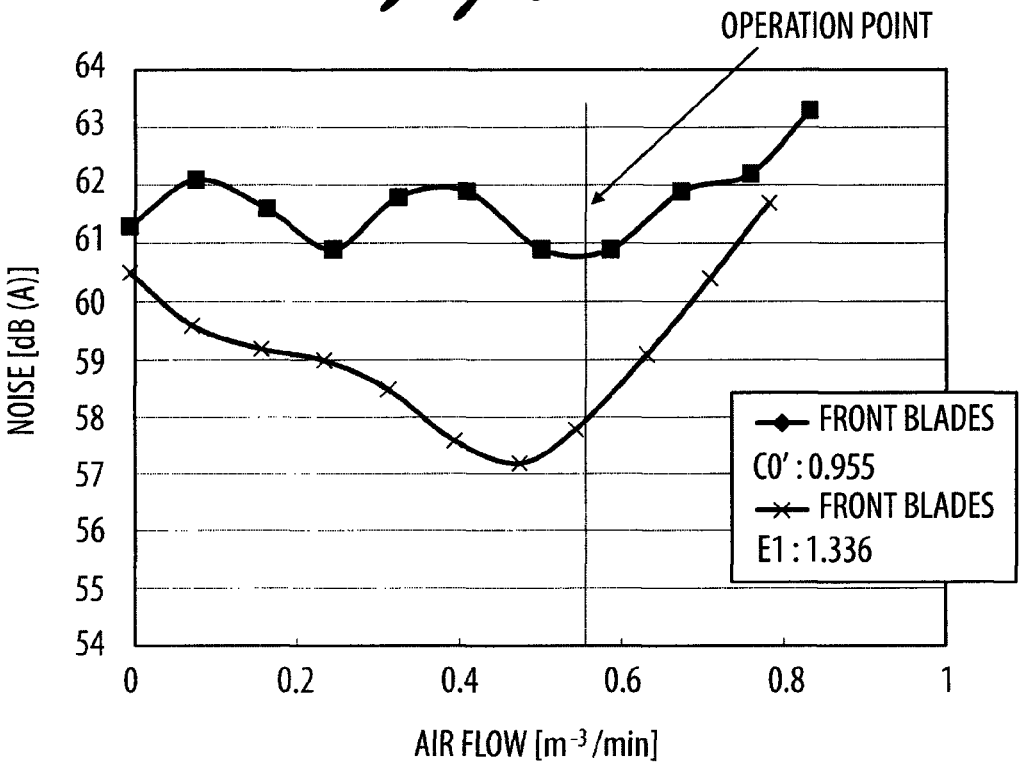

FIGS. 7A and 7B are respectively graphs showing the static pressure—air flow characteristics and the noise—air flow characteristics measured for Example E1 and Comparative Example C0' of FIG. 5. As seen from these graphs, if a comparison is made between counter-rotating axial flow fans with the solidity of the rear blades defined by the above relationship 2 set to be fixed and with the solidity of the front blades defined by the above relationship 2 respectively set to 0.955 and 1.336, noise can be reduced with the counter-rotating axial flow fan with the solidity of the front blades set to 1.336 at an operation point with no significant variations in static pressure—air flow characteristics. Although not shown in FIG. 7, it has been verified through simulation that the effect is obtained with the solidity of the front blades set to 1.25 or more. The upper limit of the solidity of the front blades is inevitably determined under conditions of manufacturing actual products, and thus the solidity of the front blades will not be an infinite value.

While one of the solidities of the front blades and the rear blades is fixed and the other of the solidities is varied in FIGS. 6 and 7, it also has been verified through simulation that the effect is obtained even if both the solidities of the front blades and the rear blades are varied as far as the above relationship 2 is satisfied.

Figure 8A:
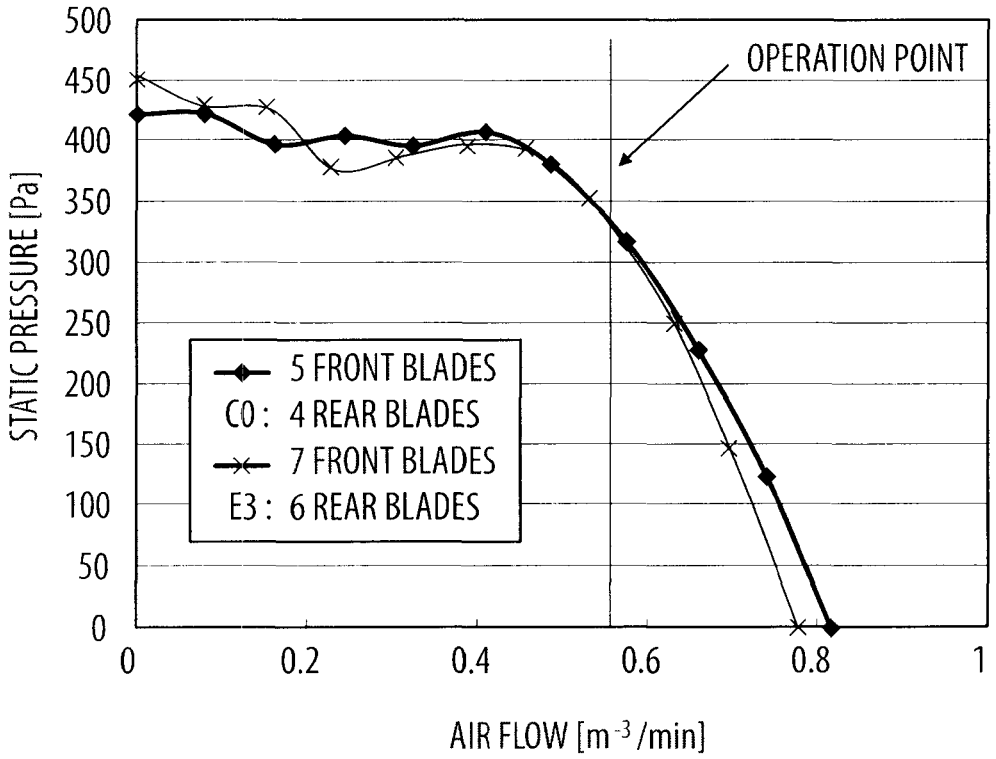
FIGS. 8A and 8B are respectively graphs showing the static pressure—air flow characteristics and the noise—air flow characteristics measured for Example E3 and Comparative Example C0 of FIG. 5.
Figure 8B:
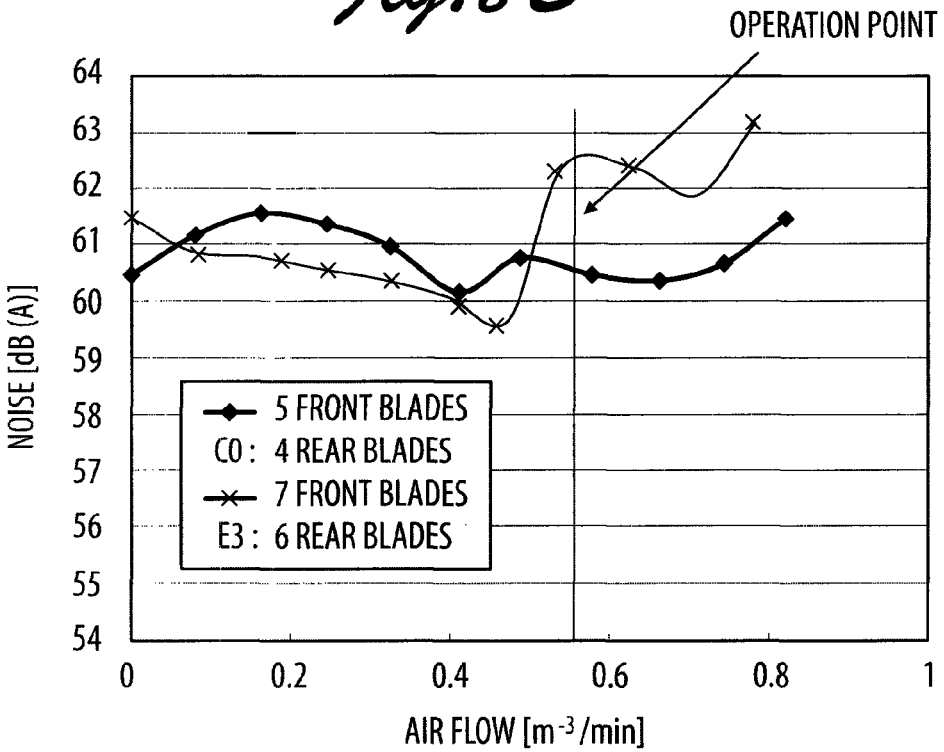
Figure 9:
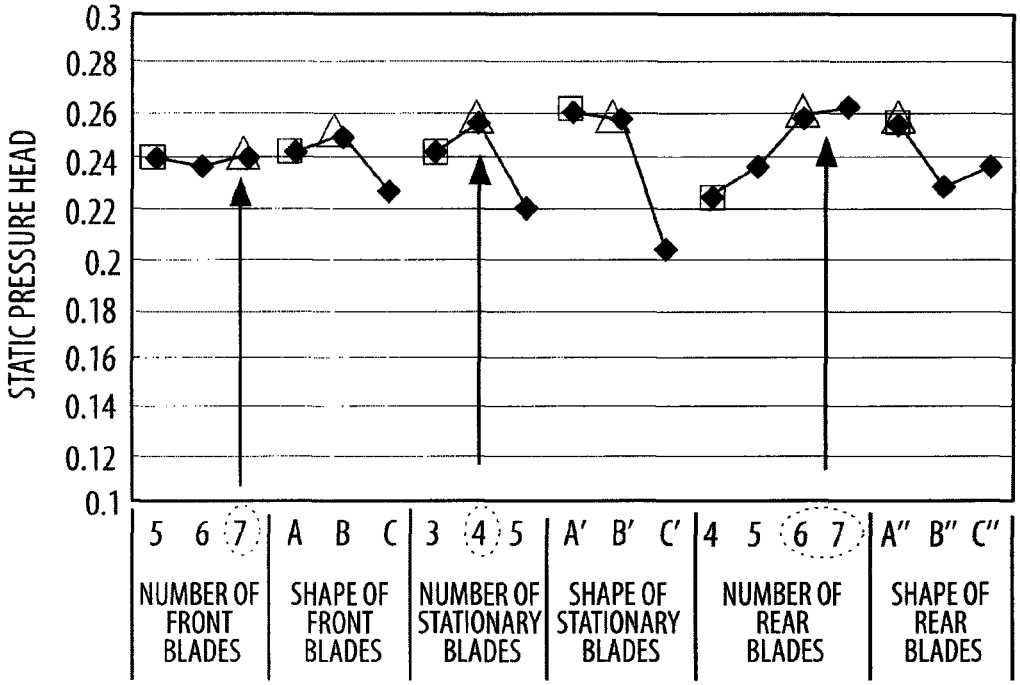
FIG. 9 shows the results of simulating the sensitivity of the amount of variation in static pressure head when the number of front blades, the number of rear blades, the number of stationary blades, and the shape of the blades are varied.

FIGS. 8A and 8B are respectively graphs showing the static pressure—air flow characteristics and the noise—air flow characteristics measured for Example E3 and Comparative Example C0 of FIG. 5. FIG. 9 shows the results of simulating the sensitivity of the amount of variation in static pressure head (results of analyzing the sensitivity using an orthogonal array) when the number of front blades, the number of rear blades, the number of stationary blades, and the shape of the blades are varied. As seen from the graph of FIG. 8, noise is increased by varying the number of the front blades and the number of the rear blades at an operation point with no significant variations in static pressure—air flow characteristics. In addition, according to the simulation, as seen in FIG. 9, the number N of the front blades, the number P of the rear blades, and the number M of the stationary blades preferably satisfy the relationships of $5 \leq N \leq 7$, $4 \leq P \leq 7$, and $3 \leq M \leq 5$.

FIG. 9 shows the results of analyzing the sensitivity under variable conditions. The sensitivity analysis results of FIG. 9 are represented in a factor effect diagram showing the results of applying three levels (5, 6, and 7) for the number of the front blades, three levels (A, B, and C) for the shape of the front blades, three levels (3, 4, and 5) for the number of the stationary blades, three levels (A', B', and C') for the shape of the stationary blades, four levels (4, 5, 6, and 7) for the number of the rear blades, and three levels (A", B", and C") for the shape of the rear blades to an orthogonal array L18 for analysis. The orthogonal array L18 is prepared to include 18 cases in which all the three factors (the front blades, the stationary blades, and the rear blades) and all the levels for each of the factors appear the same number of times, and is commonly used for statistical judgment to judge the superiority, the effect and the combination for all the combinations ($3\times3\times3\times3\times4\times3=972$ cases) through only 18 simulations.

The values of the "static pressure head" of FIG. 9 are calculated as follows. Taking the case where the "number of front blades" is "7" as an example, there are six combinations, in which the "number of front blades" is "7", among the 18 simulation results of the orthogonal array L18 (because there are three levels for the "number of front blades"). The values of the "static pressure head" for the six combinations are averaged to obtain the value of the "static pressure head" for the case where the "number of front blades" is "7" of FIG. 9. Although the simulation results of the orthogonal array L18 are not shown, the value of the "static pressure head" for the case where the "number of front blades" is "7" is calculated as $(0.211+0.203+0.310+0.201+0.250+0.277)/6=0.242$. Values of the static pressure head are obtained for each of the other factors and the other levels through similar calculations, and are shown in FIG. 9. In the orthogonal array L18, all the factors and all the levels appear the same number of times in the 18 cases. Therefore, a value obtained by averaging values for a particular level of a particular factor can be considered as an index of the tendency of the magnitude for the level of the factor relative to the other levels of the factor. Thus, the sensitivity analysis results of FIG. 9 can be used to choose the best of the levels for each of the factors (the front blades, the stationary blades, and the rear blades).

The shape "A" of the front blades corresponds to the shape of the front blades according to Comparative Example C0 of FIG. 5. The shape "B" corresponds to the shape of the blades according to Example E3 of FIG. 5. The shape "C" corresponds to the shape of the blades according to Comparative Example C0' of FIG. 5.

In the configuration according to Comparative Example C0 of FIG. 9, for example, the "number of front blades" is "5", the "shape of front blades" is "A", the "number of stationary blades" is "3", the "shape of stationary blades" is "A'", the number of rear blades" is "4", and the "shape of rear blades" is "A"". As seen from FIG. 9, substantially equivalent fine performances are obtained at the "number of front blades" of "5" and "7". Fine performance is obtained at the "shape of front blades" of "B". Likewise, it can be judged that fine performance is obtained at the "number of stationary blades" of "4"; fine performances are obtained at the "shape of stationary blades" of "A'" and "B'"; fine performance is obtained at the "number of rear blades" of "6" and "7"; and fine performance is obtained at the "shape of rear blades" of "A"".

The overall static pressure head was obtained through simulation for a combination of levels with the best performance and combinations of levels with equivalent performances to the best performance. As a result, an overall static pressure head of 0.31 was obtained through simulation in a combination of the "number of front blades" of "7", the "shape of front blades" of "B", the "number of stationary blades" of "4", the "shape of stationary blades" of "B'", the "number of rear blades" of "6", and the "shape of rear blades"

of "A'" (Example E1 of FIG. 5). An overall static pressure head of 0.31 obtained with the counter-rotating axial flow fan according to Example E1 of FIG. 5 is higher than an overall static pressure head of 0.26 obtained through simulation with the conventional counter-rotating axial flow fan (Comparative Example C0 of FIG. 5). The effect of the present invention has thus been verified.

In FIG. 9, the combination indicated by the arrows is optimum, and corresponds to Example E1 of FIG. 5.

While certain features of the invention have been described with reference to example embodiments, the description is not intended to be construed in a limiting sense. Various modifications of the example embodiments, as well as other embodiments of the invention, which are apparent to persons skilled in the art to which the invention pertains, are deemed to lie within the spirit and scope of the invention.

What is claimed is:

1. A counter-rotating axial flow fan comprising:

a casing including an air channel having a suction port on one side in an axial direction and a discharge port on the other side in the axial direction;

a front impeller including a plurality of front blades and configured to rotate in the air channel;

a rear impeller including a plurality of rear blades and configured to rotate in the air channel in a direction opposite to a direction of rotation of the front impeller; and a plurality of support members formed by a plurality of stationary blades or a plurality of struts disposed to be stationary between the front impeller and the rear impeller in the air channel, wherein defining the number of the front blades as N, the number of the support members as M, and the number of the rear blades as P, N, M, and P each being a positive integer, and defining the maximum axial chord length of the front blades as Lf, the maximum axial chord length of the rear blades as Lr, the outside diameter of the front blades as Rf, and the outside diameter of the rear blades as Rr, Lf, Lr, Rf, and Rr each being a positive integer, the following relationships are satisfied:

$N \geq P > M$; and at least one of $Lf/(Rf \times \pi/N) \geq 1.25$ and $Lr/(Rr \times \pi/P) \geq 0.83$;

defining the rotational speed of the front impeller as Sf and the rotational speed of the rear impeller as Sr, a relationship of Sf>Sr is satisfied; and, the following relationships are further satisfied:

$5 \leq N \leq 7, 4 \leq P \leq 7$, and $3 \leq M \leq 5$;

$1 > Lr/Lf > 0.45$; and $Lf/(Rf \times \pi/N) > Lr/(Rr \times \pi/P)$.

2. The counter-rotating axial flow fan according to claim 1, wherein a relationship of $Lr/(Rr \times \pi/P) \geq 1.00$ is satisfied.

3. The counter-rotating axial flow fan according to claim 1, wherein:

the front impeller and the rear impeller are each formed by fixing the plurality of blades to an outer peripheral portion of a hub thereof; and the radial dimension of the hub of the rear impeller becomes smaller toward the discharge port.

4. The counter-rotating axial flow fan according to claim 1, wherein:

the front impeller and the rear impeller are each formed by fixing the plurality of blades to an outer peripheral portion of a hub thereof;

the radial dimension of the hub of the rear impeller becomes smaller toward the discharge port; and an inclination angle of the hub of the rear impeller is less than 60 degrees.

5. The counter-rotating axial flow fan according to claim 1, wherein:

the front impeller and the rear impeller are each formed by fixing the plurality of blades to an outer peripheral portion of a hub thereof;

the radial dimension of the hub of the rear impeller becomes smaller toward the discharge port; and end portions of the rear blades are in contact with an end portion of the hub of the rear impeller on the discharge side.

6. The counter-rotating axial flow fan according to claim 1, wherein:

the front impeller and the rear impeller are each formed by fixing the plurality of blades to an outer peripheral portion of a hub thereof;

the radial dimension of the hub of the rear impeller becomes smaller toward the discharge port; and end surfaces of the rear blades of the rear impeller on the discharge side are disposed more inwardly than an end surface of the casing on the discharge side not to project from the end surface of the casing on the discharge side.

7. The counter-rotating axial flow fan according to claim 1, wherein:

the front impeller and the rear impeller are each formed by fixing the plurality of blades to an outer peripheral portion of a hub thereof;

the radial dimension of the hub of the rear impeller becomes smaller toward the discharge port; and end surfaces of the rear blades of the rear impeller on the discharge side are disposed more inwardly than an end surface of the casing on the discharge side by 0.1 to 0.5 times the diameter of the rear blades.

8. A counter-rotating axial flow fan comprising:

a casing including an air channel having a suction port on one side in an axial direction and a discharge port on the other side in the axial direction;

a front impeller including a plurality of front blades and configured to rotate in the air channel;

a rear impeller including a plurality of rear blades and configured to rotate in the air channel in a direction opposite to a direction of rotation of the front impeller; and a plurality of support members formed by a plurality of stationary blades or a plurality of struts disposed to be stationary between the front impeller and the rear impeller in the air channel, wherein:

defining the number of the front blades as N, the number of the support members as M, and the number of the rear blades as P, N, M, and P each being a positive integer, and defining the maximum axial chord length of the front blades as Lf, the maximum axial chord length of the rear blades as Lr, the outside diameter of the front blades as Rf, and the outside diameter of the rear blades as Rr, Lf, Lr, Rf, and Rr each being a positive integer, the following relationships are satisfied:

$N \geq P > M$; and a relationship of $Lf/(Rf\times\pi/N)\geq 1.59$ is satisfied; and, defining the rotational speed of the front impeller as Sf and the rotational speed of the rear impeller as Sr, a relationship of $Sf>Sr$ is satisfied.

9. The counter-rotating axial flow fan according to claim 8, wherein a relationship of $Lr/(Rr\times\pi/P)\geq 1.00$ is satisfied.

10. The counter-rotating axial flow fan according to claim 8, wherein:

the front impeller and the rear impeller are each formed by fixing the plurality of blades to an outer peripheral portion of a hub thereof; and the radial dimension of the hub of the rear impeller becomes smaller toward the discharge port.

11. The counter-rotating axial flow fan according to claim 8, wherein:

the front impeller and the rear impeller are each formed by fixing the plurality of blades to an outer peripheral portion of a hub thereof;

the radial dimension of the hub of the rear impeller becomes smaller toward the discharge port; and an inclination angle of the hub of the rear impeller is less than 60 degrees.

12. The counter-rotating axial flow fan according to claim 8, wherein:

the front impeller and the rear impeller are each formed by fixing the plurality of blades to an outer peripheral portion of a hub thereof;

the radial dimension of the hub of the rear impeller becomes smaller toward the discharge port; and end portions of the rear blades are in contact with an end portion of the hub of the rear impeller on the discharge side.

13. The counter-rotating axial flow fan according to claim 8, wherein:

the front impeller and the rear impeller are each formed by fixing the plurality of blades to an outer peripheral portion of a hub thereof;

the radial dimension of the hub of the rear impeller becomes smaller toward the discharge port; and end surfaces of the rear blades of the rear impeller on the discharge side are disposed more inwardly than an end surface of the casing on the discharge side not to project from the end surface of the casing on the discharge side.

14. The counter-rotating axial flow fan according to claim 8, wherein:

the front impeller and the rear impeller are each formed by fixing the plurality of blades to an outer peripheral portion of a hub thereof;

the radial dimension of the hub of the rear impeller becomes smaller toward the discharge port; and end surfaces of the rear blades of the rear impeller on the discharge side are disposed more inwardly than an end surface of the casing on the discharge side by 0.1 to 0.5 times the diameter of the rear blades.

15. A counter-rotating axial flow fan comprising:

a casing including an air channel having a suction port on one side in an axial direction and a discharge port on the other side in the axial direction;

a front impeller including a plurality of front blades and configured to rotate in the air channel;

a rear impeller including a plurality of rear blades and configured to rotate in the air channel in a direction opposite to a direction of rotation of the front impeller; and a plurality of support members formed by a plurality of stationary blades or a plurality of struts disposed to be stationary between the front impeller and the rear impeller in the air channel, wherein:

defining the number of the front blades as N, the number of the support members as M, and the number of the rear blades as P, N, M, and P each being a positive integer, and defining the maximum axial chord length of the front blades as Lf, the maximum axial chord length of the rear blades as Lr, the outside diameter of the front blades as Rf, and the outside diameter of the rear blades as Rr, Lf, Lr, Rf, and Rr each being a positive integer, the following relationships are satisfied:

$N\geq P>M$; and a relationship of $Lf/(Rf\times\pi/N)$ 1.59 is satisfied.

* * * * *